Fig. 1.
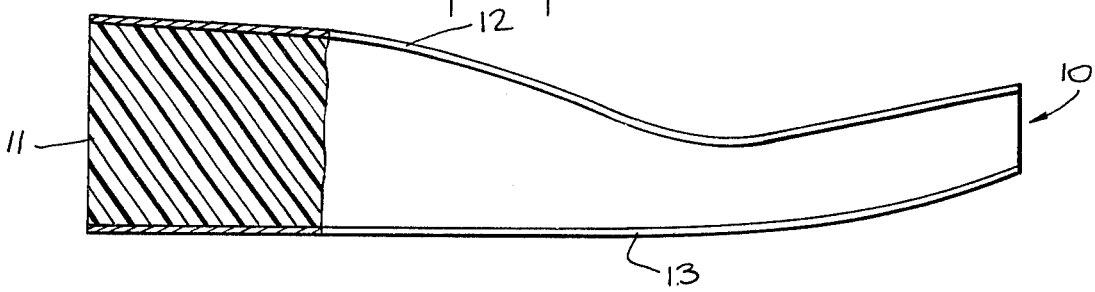
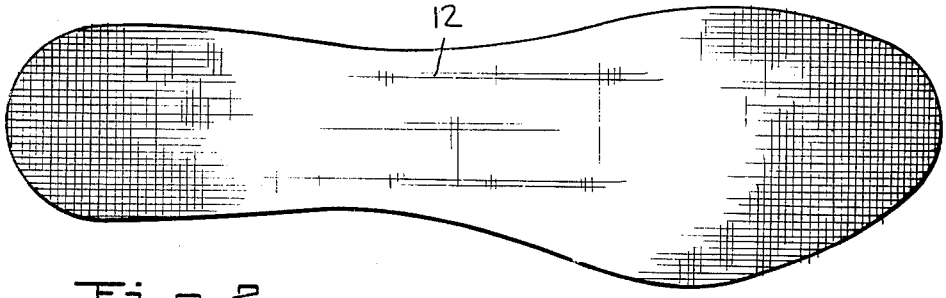
Fig. 2.
Fig. 3.
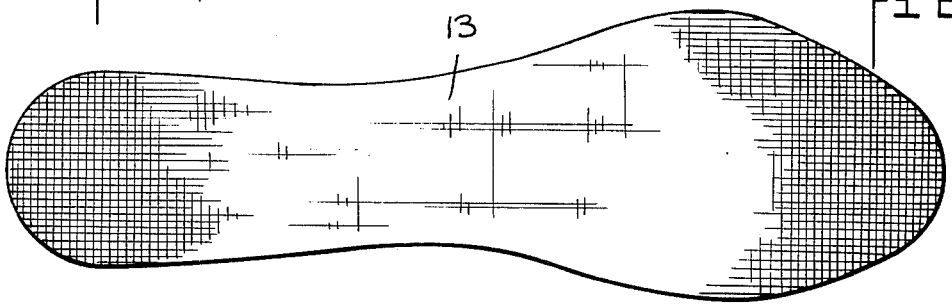
Fig. 4.
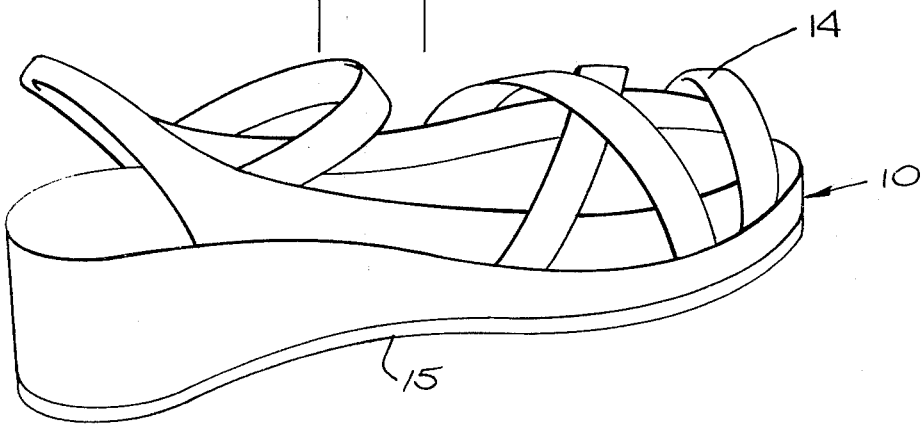

United States Patent [19]

Pietraszek

[11] 3,972,135

[45] Aug. 3, 1976

[54] PLATFORM FOR FOOTWEAR AND ARTICLE OF FOOTWEAR

[75] Inventor: Thaddeus Pietraszek, Waterbury, Conn.

[73] Assignee: Uniroyal Inc., New York, N.Y.

[22] Filed: May 22, 1975

[21] Appl. No.: 580,079

[52] U.S. Cl. ..... 36/30 R
[51] Int. Cl.[2] ..... A43B 13/16
[58] Field of Search ..... 36/30 R, 44, 11.5

[56] References Cited

UNITED STATES PATENTS

| | | | |
|---|---|---|---|
| 2,343,700 | 3/1944 | Pickens | 36/30 R |
| 3,345,762 | 10/1967 | Fisher et al. | 36/30 R |
| 3,352,033 | 11/1967 | Colley | 36/11.5 |

*Primary Examiner*—Patrick D. Lawson
*Attorney, Agent, or Firm*—Charles A. Blank

[57] ABSTRACT

A platform for footwear utilizing a rigid or semi-rigid body of polyurethane foam having a layer of fabric integral with the body and forming the upper surface of the platform. The polyurethane body also has a layer of fabric integral therewith and forming the lower surface of the platform. The platform does not crack or crumble under repeated flexings in the stressed ball-of-the-foot area.

5 Claims, 4 Drawing Figures

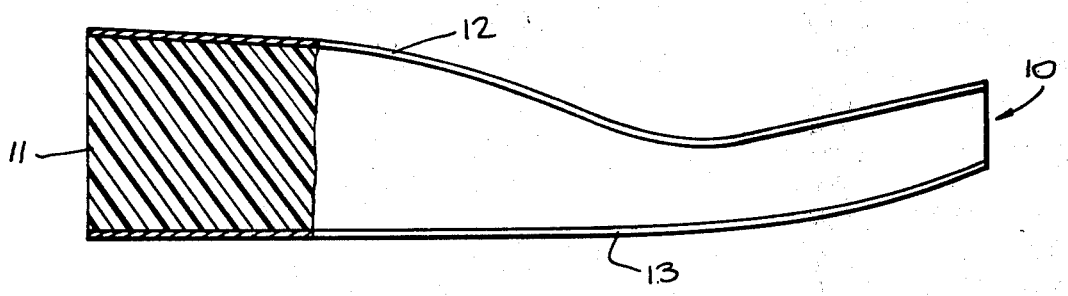

PLATFORM FOR FOOTWEAR AND ARTICLE OF FOOTWEAR

This invention relates to platforms for footwear and to articles of footwear utilizing such platforms.

Heretofore, most platforms for shoes have been made from cork or wood, both of which must be cut and shaped during manufacture, adding to the cost. Some solid or near solid types of platforms have been made from flexible, soft microcellular polyurethane, but such platforms do not have the desirable hardness comparable to rigid or semi-rigid cork or wood platforms.

Prior attempts to utilize semi-rigid or rigid polyurethane in platforms have been unsuccessful because the platform cracked or crumbled in the stress area of the ball-of-the-foot under repeated flexings.

It is an object of the present invention, therefore, to provide a new and improved platform for an article of footwear avoiding one or more of the above-mentioned disadvantages of prior such platforms.

It is another object of the invention to provide a new and improved shoe utilizing a platform which avoids one or more of the above-mentioned disadvantages of prior such platforms.

It is another object of the invention to provide a new and improved platform for an article of footwear, which platform is rigid or semi-rigid and hard and does not crack under repeated flexings and can be molded.

In accordance with the invention, a platform for footwear comprises a body of polyurethane foam having a compression modulus in the range of 150 to 400 pounds per square inch, a first layer of fabric integral with the body over the entire surface of the first fabric layer and forming the upper surface of the platform, and a second layer of fabric integral with the body over the entire surface of the second fabric layer and forming the lower surface of the platform.

Also in accordance with the invention, an article of footwear comprises a platform comprising a body of polyurethane foam having a compression modulus in the range of 150 to 400 pounds per square inch, a first layer of fabric integral with the body over the entire surface of the first fabric layer and forming the upper surface of the platform, and a second layer of fabric integral with the body over the entire surface of the second fabric layer and forming the lower surface of the platform. The article includes an upper attached to the platform and a sole attached to the platform.

As used herein, the term "platform" includes a platform as, for example, represented in the drawings and also includes a portion of a sole or heel of an article of footwear.

For a better understanding of the present invention, together with other and further objects thereof, reference is made to the following description, taken in connection with the accompanying drawings, and its scope will be pointed out in the appended claims.

Referring now to the drawings:

FIG. 1 is a side elevational view of a platform constructed in accordance with my invention;

FIG. 2 is a plan view of the FIG. 1 platform;

FIG. 3 is a bottom plan view of the FIG. 1 platform; and

FIG. 4 is a perspective view of a shoe constructed in accordance with the invention and utilizing the FIG. 1 platform.

Referring now more particularly to FIGS. 1, 2 and 3 of the drawings, a platform 10 for footwear comprises a body 11 of polyurethane foam having a compression modulus in the range of 150 to 400 pounds per square inch. The compression modulus preferably is 300 pounds per square inch. Thus, the platform 10 is rigid or semi-rigid.

The platform 10 has a density in the range of 5 to 35 pounds per cubic foot and preferably is 17 pounds per cubic foot.

The platform 10 has a layer of fabric 12 integral with the body 11 and forming the upper surface of the platform 10. The platform 10 also has a layer of fabric 13 integral with the body 11 and forming the lower surface of the platform 10.

The layers of fabric 12, 13 preferably are a textile material, for example, a woven material. The layers of fabric 12, 13 may also be, for example, knitted material, unidirectional material such as tire cord, or nonwoven material. The layers of fabric 12, 13 may also be, for example, natural, synthetic or metallic material such as, for example, cotton, rayon, nylon, glass or steel. The material may be positioned in line with the longitudinal direction of the platform or at a biased angle therewith.

The formulation for providing a microcellular polyurethane foam body 11 preferably is as follows:

| Ingredient | Parts/100 Weight |
|---|---|
| (475 OH number) Polyglycol[1] | 17.6 |
| Polypropyleneglycol based triol[2] (approximately 4700 molecular weight) | 21.2 |
| Water | 0.2 |
| Triethylenediamine[3] | 1.0 |
| Crude MDI (methylene di-para-phenylene isocyanate)[4] | 60.0 |
| Total | 100.0 |

[1]Union Carbide LA 475
[2]Dow Chemical CP-4701
[3]Air Products and Chemicals Dabco
[4]Rubicon Rubinate M The polyurethane body 11 and integral fabrics 12, 13 may be made by, for example, cast or injection molding the body 11 in a suitable mold with the fabrics 12, 13 positioned in the mold so that during molding they become integral with the body 11 and form the upper and lower surfaces thereof.

FIG. 4 represents a platform shoe having an upper 14 and sole 15 attached to the platform 10.

I have found that platforms constructed in accordance with the invention have a long flexural fatigue life and do not crack or crumble under repeated bendings in both the up and down directions in the ball-of-the-foot area. I believe this is because the fabric prevents elongation of the polyurethane body on the side bent with a convex curvature.

Also, the fabrics 12, 13 integral with the polyurethane body 11 facilitate the fabrication of shoes without the need for special treatments of the platform for attachment of the uppers and soles. Further, the platform is of extremely light weight notwithstanding that it appears heavy when incorporated in a shoe.

While there have been described what at present are believed to be the preferred embodiments of this invention, it will be obvious to those skilled in the art that various changes and modifications may be made therein without departing from the invention, and it is, therefore, aimed to cover all such changes and modifications as fall within the spirit and scope of the invention.

I claim:

1. A platform for footwear comprising:

a body of polyurethane foam having a compression modulus in the range of 150 to 400 pounds per square inch;

a first layer of fabric integral with said body over the entire surface of said first fabric layer and forming the upper surface of the platform; and a second layer of fabric integral with said body over the entire surface of said second fabric layer and forming the lower surface of the platform.

2. A platform in accordance with claim 1 in which said body has a density in the range of 5 to 30 pounds per cubic foot.

3. A platform in accordance with claim 1 in which said layers of fabric are textile material.

4. A platform in accordance with claim 1 in which said layers of fabric are woven material.

5. An article of footwear comprising:

a platform comprising a body of polyurethane foam having a compression modulus in the range of 150 to 400 pounds per square inch, a first layer of fabric integral with said body over the entire surface of said first fabric layer and forming the upper surface of said platform, and a second layer of fabric integral with said body over the entire surface of said second fabric layer and forming the lower surface of said platform;

an upper attached to said platform; and a sole attached to said platform.

* * * * *